United States Patent [19]

Eslien et al.

[11] 4,012,309

[45] Mar. 15, 1977

[54] APPARATUS FOR MANUFACTURING PELLET SIZING SCREEN RODS

[75] Inventors: Dean R. Eslien; James Salnick, both of Abrams, Wis.

[73] Assignee: Ultra Plating Corporation, Green Bay, Wis.

[22] Filed: May 27, 1975

[21] Appl. No.: 581,092

[52] U.S. Cl. ..... 204/297 W; 204/34; 204/DIG. 7

[51] Int. Cl.[2] ..... C25D 17/08; C25D 17/06

[58] Field of Search ..... 204/DIG. 7, 297 W, 231, 204/27, 15, 34

[56] References Cited

UNITED STATES PATENTS

| | | | |
|---|---|---|---|
| 1,721,414 | 7/1929 | Robe | 204/297 W |
| 1,738,515 | 12/1929 | Belke | 204/DIG. 7 |
| 1,899,992 | 3/1933 | Sohn | 204/DIG. 7 |
| 2,044,431 | 6/1936 | Harrison | 204/DIG. 7 |
| 2,541,597 | 2/1951 | Midling | 204/297 W |
| 2,898,285 | 8/1959 | Henson | 204/297 W |

*Primary Examiner*—T. M. Tufariello
*Attorney, Agent, or Firm*—James E. Nilles

[57] ABSTRACT

Methods and apparatus are disclosed for manufacturing pellet sizing screen rods by applying a chromium plating or coating to elongated stainless steel and carbon steel rod cores of regular (circular) or irregular (T-shaped) cross sectional configuration. The method concerns surface grinding or blasting, cleaning, electroetching, electroplating, and sour-rinsing the rod cores. The apparatus concerns the construction of frames for supporting the rod cores during plating, as well as the construction, arrangement and proportions of the theivers and the plating anode means employed during plating.

12 Claims, 16 Drawing Figures

APPARATUS FOR MANUFACTURING PELLET SIZING SCREEN RODS

BACKGROUND OF THE INVENTION

1. Field of Use

This invention relates generally to methods and apparatus for manufacturing metal rods used in pellet sizing screens. In particular, it relates to methods and apparatus for applying chromium plating to elongated stainless steel and carbon steel rod cores of regular (circular) or irregular (T-shaped) cross sectional configuration.

2. Description of the Prior Art

Low grade iron ore such as taconite is processed by crushing to fine powder, magnetically separating the magnetite from unwanted silica, mixing the magnetite with a clay, such as bentonite, and water, feeding the resultant slurry to a hollow rotatable balling drum which forms the slurry into generally spherical green or unfired pellets and then discharging the pellets from the drum onto a pellet sizing screen which separates undersized ore pellets from those of a generally uniform desired size. The sizing screen, which may take any of several known forms, comprises a plurality of laterally spaced apart elongated metal screen rods between which undersized pellets drop onto a conveyor for reprocessing, whereas pellets of desired size are advanced along the screen for further processing.

Vibrating screens, for example, typically comprise rods of circular cross section. Trommel or rotating screens typically comprise arcuately shaped profile rods of T-shaped cross section which are arranged in rings and disposed in a coaxial conical arrangement at the end of the balling drum and are rotatable therewith. Roll screens comprise a plurality of laterally spaced apart rotatable rods of circular cross section serving as rollers onto which pellets are discharged from the balling drum.

The pellets being screened are highly abrasive and tend to mechanically wear down and break the metal rods forming the screen. Furthermore, since the magnetite in the pellets has magnetic properties, screen rods fabricated of ferromagnetic material tend to attract pellet particles and other magnetizable debris which adheres magnetically to the rods which interferes with the spacing between rods and affects screen efficiency. Replacement of worn or broken rods and cleaning of clogged screens requires shutdown of the apparatus, or some other mechanical means, and is costly and time consuming.

Stainless steel rods having non-magnetic properties overcome the aforementioned magnetic problems but are relatively expensive initially and are difficult to repair by welding when worn or broken. On the other hand, rods formed of non-magnetic metals other than stainless steel are much more prone to abrasive wear than rods formed of stainless steel or ferromagnetic materials such as carbon steel.

U.S. Pat. No. 3,848,744 suggests that screen rods be fabricated of a metal inner core having appropriate fatigue resistance, cost and workability and comprising a material such as plain carbon steel or other ferromagnetic material or non-ferrous, non-magnetic material such as nickel, aluminum, stainless steel or copper alloys. That patent further suggests that the inner core be provided with an attached outer shell having a high degree of abrasion resistance and paramagnetic properties and consisting of a plating of hard chromium, or tungsten carbide, or pyrolite carbon or molybdenum, which outer shell could be applied by standard electrolytic processes, fusion at high temperatures, sintering, or application through a plasma arc.

SUMMARY OF THE PRESENT INVENTION

The present invention generally related to methods and apparatus for electroplating metal and, in particular, for applying chromium plating to stainless steel or carbon steel to increase the abrasion resistance of the metal and to impart, where necessary, paramagnetic properties to the plated metal. The methods and apparatus in accordance with the invention are especially well adapted to the manufacture of pellet sizing screen rods comprising a metal core and an outer plating or coating and used in sizing screens for balling drums to separate undersized ore pellets from those of desired size, such rods being straight or curved, and of regular (circular) or irregular (T-shaped) cross section.

The general method in accordance with the invention comprises the steps of: abrading as by grinding the metal rod core surface as on a centerless grinder or sand blasting to break open and expose any subsurface pockets in which carbon or other impurities may be and ensure a good plating surface, chemically or mechanically cleaning the metal rod core to remove dirt and other properties which impair bonding by subjecting the cleaned metal rod core to a soap, alkaline or acid rinse thus actuating the exposed surface, submerging the metal rod core in a chromium plating bath along with a submerged multisection lead alloy anode or electrode, initiating electric current flow from a reversible adjustable direct current source in one direction to effect etching of the metal rod, reversing the direction of current flow to effect plating, changing current flow in predetermined stages at the commencement of plating, maintaining a constant predetermined amperage and voltage for a predetermined interval of time to effect a desired thickness of plating on the rod core, rinsing the plated rod in water, and finally rinsing the plated rod in a sour rinse to provide a desired finish and appearance.

Apparatus in accordance with the present invention generally comprises a tank containing a suitable chromium plating bath, a source of reversible adjustable direct current, lead alloy plating anode or electrode means arranged in one or more sections, and rod supporting and connecting means (hereinafter called a frame) for holding one or more rod cores immersed in the plating bath, for conducting electric current thereto, and for ensuring even dispersion of the plating on the rod cores. The rod cores are releasably mounted on the frame and positioned with respect to the horizontal so as to enhance release of gas bubbles formed on the surface thereof. The frame includes electrically conductive terminal means for electrically connecting two spaced apart points on each rod core to one side of the direct current source. A generally conforming electrically conductive theiver is mounted on the frame and is electrically connected to the same side of the direct current source as the rod cores and physically surrounds those portions of the rod cores which are immersed in the bath and to be plated. The theiver has an effective electrically conductive exposed surface area proportional to the total area of the rod cores being plated.

The plating anode comprises about 25% more working area than the total of the electrically conductive immersed exposed (uninsulated) portion of the frame and rod core area being plated and is disposed in separate sections which are located on opposite sides of the rod core being plated. In plating rod cores of regular symmetrical cylindrical cross sectional configuration, equal amounts of the total anode area are disposed on opposite sides of the rod cores. In plating curved profile rod cores of generally T-shaped irregular cross sectional configuration, proportional amounts of the total anode area are disposed on opposite sides of the rod core and one section of the plating anode conforms in general shape to the shape of the rod core being plated to effect proper and equalized dispersion of the plating.

The frame for supporting elongated curved profile rod cores having a generally T-shaped cross sectional configuration comprises adjustable, submersible, electrically conductive clamping means for supporting a plurality of profile rod cores in generally vertically spaced apart relationship, with each profile rod core being sloped about 5° from the horizontal to facilitate dispersal of hydrogen bubbles being formed during plating on the under surface of the rod core. Furthermore, the frame is provided with bumper or spacing means for automatically spacing the frame and the profile rods thereon a predetermined distance from the plating anode.

The frame for supporting relatively long straight rod cores having a generally circular cross sectional configuration comprises adjustable, submersible, electrically conductive current carrying clamping means for supporting a plurality of rod cores in generally horizontally spaced apart relationship, with each rod core extending substantially vertically, whereby hydrogen bubbles are easily dispersed from the rod core surface. The lower portions of the cylindrical rod cores are submerged in the plating bath and plated first and subsequently the rod cores are reversed on the frame and the remaining portions of the rod cores are then plated in such a manner as to provide a double-plated overlap joint.

The methods and apparatus in accordance with the invention offer numerous advantages over prior art plating methods and plating apparatus. For example, the method insures a very clean rod core surface to which the chromium plating can firmly adhere. The step of abrading by grinding or blasting with particles breaks open and exposes any subsurface pockets in the rod core in which impurities such as carbon or air bubbles may be lodged and insures continuous plating. The step of cleaning in an appropriate bath removes impurities in the rod surface. The initial reversal of current to effect etching also improves surface conditions to insure good plating adhesion.

The slow start in the application of plating current in connection with plating stainless steel rod cores having a relatively high chromium content takes into account the higher chromium content of the stainless steel and assures that the initial deposit of metal plating will be more securely bonded to the rod core. The shape, disposition and proportioning of the plating anode sections with respect to the rod cores insures that plating material is evenly deposited on all rod core surfaces and, particularly in connection with the irregularly shaped profile rod cores, prevents the build-up of uneven sharp corners of plating material at the corners or edges of the front principal working surface of the rod cores. The size, arrangement, and path of current flow through the frame and theiver also facilitates even current flow to the rod core surfaces and insures plating of uniform thickness on the desired areas of the rod core. The arrangement of the rod cores on the frame insures that gas bubbles formed during the plating process are easily dispersed from the rod core surfaces so as not to interfere with even plating. The construction of the frames is such as to insure quick, regular and firm mechanical and electrical connection of the rod cores to the frame and thence to the power source. The frame is provided with means to insure proper spacing of the rod cores with respect to the plating anodes. Chromium plating of screen rod cores in accordance with the invention extends rod life about six times over presently used unplated rods, thereby reducing balling mill downtime, or the need for expensive mechanical cleaning apparatus and reducing costs connected with purchase and replacement of rods. Although the present invention is disclosed herein in connection with various types of rods which are particularly well adapted for use in sizing screens for balling mills, it is apparent that the methods and apparatus in accordance with the invention are applicable to other types of components requiring excellent plating bondage and subject to the extreme abrasive action of taconite or abrasives in a vibrating environment, for example.

DRAWINGS

DESCRIPTION OF PREFERRED EMBODIMENTS

Figure 1:
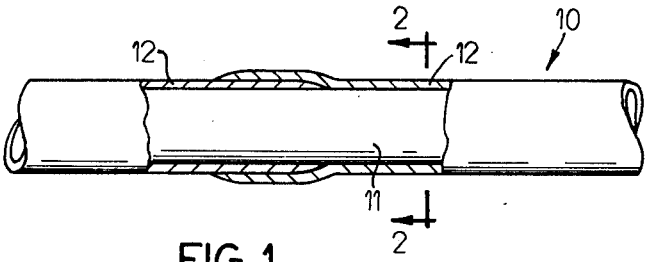
FIG. 1 is a view, partly in cross section, or a portion of an elongated rod of circular cross section for use in a pellet sizing screen, for example, and depicts the manner in which plating applied to the rod core is overlapped at a point on the rod in accordance with the invention.
Figure 2:
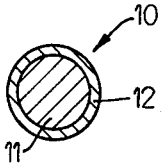
FIG. 2 is a cross section view of the cylindrical rod taken on line 2—2 of FIG. 1.

Referring to FIGS. 1 and 2, the numeral 10 designates an elongated screen rod of circular cross section such as is used, for example, in a vibrating type pellet sizing screen such as is shown in U.S. Pat. No. 2,707,304. Rod 10, which is on the order of about 30 inches to 180 inches long and about ⅜ inch in diameter, comprises an inner core 11 and an outer plated coating 12 applied in accordance with the invention.

Figure 3:
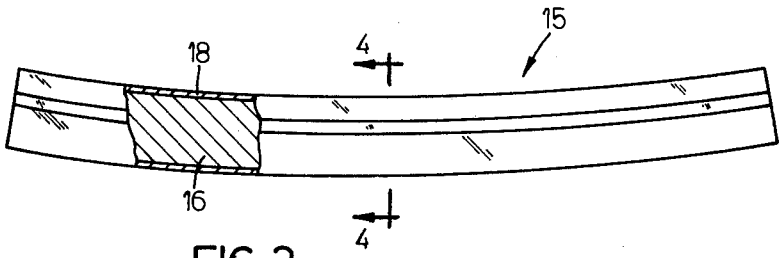
FIG. 3 is a side elevational view, partly in cross section, of a profile rod plated in accordance with the invention and for use in a pellet sizing screen, for example.
Figure 4:
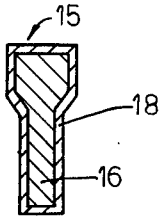
FIG. 4 is an enlarged cross section view of the profile rod taken on line 4—4 of FIG. 3.

Referring to FIGS. 3 and 4, the numeral 15 designates an elongated profile screen rod of irregular or generally T-shaped cross section such as is used, for example, in a trommel type rotating pellet sizing screen such as is shown in U.S. Pat. No. 2,834,043. Rod 15 is on the order of 48 to 68 inches long, ½ inch high, 3/16 inch wide at its top and 3/32 inch wide in the shank. Rod 15 comprises an inner core 16 and an outer plated coating 18 applied in accordance with the invention. Rod surface would be of any desired surface texture or configuration.

The general method of applying the chromium plating coating 12 or 18 to a core 11 or 16, respectively, in accordance with the invention comprises the steps of: abrading as by grinding or blasting the rod core surface to improve the surface condition and expose subsurface impurities, chemically or mechanically cleaning the rod core to remove dirt as by subjecting the rod core to a soaking bath in a soap solution or an alkaline descaler or an acid bath, submerging the rod core in a chromium plating bath along with a submerged lead alloy anode or electrode, initiating electric current flow from a direct current source to effect etching of the rod for 85 seconds at a current flow of about 1.1 amperes per square inch of area to be etched, reversing the current flow to effect plating of a desired thickness, rinsing the plated rod in water, and then rinsing the plated rod in a sour rinse to provide a desired finish and appearance.

In applying the general method to a stainless steel rod core, the cleaning step is preferably done chemically by immersing and soaking the rod core in a soap solution, an alkaline descaler bath or an acid bath or sequentially in any combination of these baths. In the case of the alkaline descaler bath the rod core is soaked for about 1 hour in an alkaline descaler bath maintained at a temperature of about 193° F. An alkaline descaler bath comprising a solution of about 32 ounces of alkaline descaler per gallon of water was found suitable. MacDermid Metex Alkaline Descaler 2872 was used and is a cyanide free, dry, alkaline material compounded for the purpose of removing red rust, heat treat scale, organic soils, and shop dirts from ferrous base metals.

In applying the general method to a carbon steel rod core, the abrading step is preferably done mechanically by polishing or cleaning the rod core with abrasives such as glass beads or aluminum oxides.

The sour rinse employed in the general method involved immersing the rod core or plated rod in a solution comprising about 99% water and 1% of the solution employed as the above-described alkaline descaler bath.

The step of grinding or mechanically finishing breaks open and exposes any subsurface pockets in the rod in which impurities such as carbon or air bubbles may be lodged and also insures a firm continuous plating. The initial cleaning insures a properly cleaned rod surface to which the chromium plating can firmly adhere. The initial reversal of current to effect etching also improves surface conditions to insure sound plating.

The plating bath employed in the general method to provide a hard chrome plating to the rod core is a solution of chromic acid, sulphuric acid and water, with the ratio of the chromic radical to sulphate ion being about 125/1. In practice, this ratio is produced by mixing 33 ounces of chromic acid with 0.28 ounces of sulphuric acid per gallon of water. The plating bath is maintained at about 130° F., with a temperature of 127° F being an optimum plating temperature, higher temperatures tending to keep rod core burning to a minimum.

In applying the general method to a stainless steel rod core having a high nickel content, the step of actually applying the chromium plating was carried out by electrically connecting the rod cores as cathodes and applying 1.35 amperes per square inch (asi) at 11.5 volts to the rod core area to be plated, reducing amperage to about 0.91 amperes per square inch in about a 12 second interval, and plating for about 350 minutes at 11.5 volts to provide a coating or plating on the order of 0.005 inches thick.

In applying the general method to a stainless steel rod core having a high chromium content, the step of actually applying the chromium plating was carried out by electrically connecting the rod cores as cathodes and applying current and voltages in steps or intervals in accordance with the following table:

5 volts at 0.49 asi for 35 seconds
6 volts at 0.56 asi for 25 seconds
7 volts at 0.63 asi for 40 seconds
8 volts at 0.70 asi for 40 seconds
9 volts at 0.77 asi for 30 seconds
10 volts at 0.84 asi for 30 seconds
11 volts at 0.91 asi for 30 seconds
11.5 volts at 0.93 asi for 350 minutes In applying the general method to a carbon steel rod core the full plating current may be applied at start-up and maintained without charge during plating.

As is apparent from the foregoing table, stainless steel rod cores of high chromium content are subjected to a slow start during the actual plating step to ensure a better application of the plating. It has been found that, in general, metals such as stainless steel having a higher chromium content are more perfectly bonded during plating if subjected to more etching time (i.e., on the order of 85 seconds) and a slow start in the application of plating current, whereas metals such as stainless steel containing a higher nickel content require less etching time and can tolerate a faster start in the application of plating current.

Figure 5:
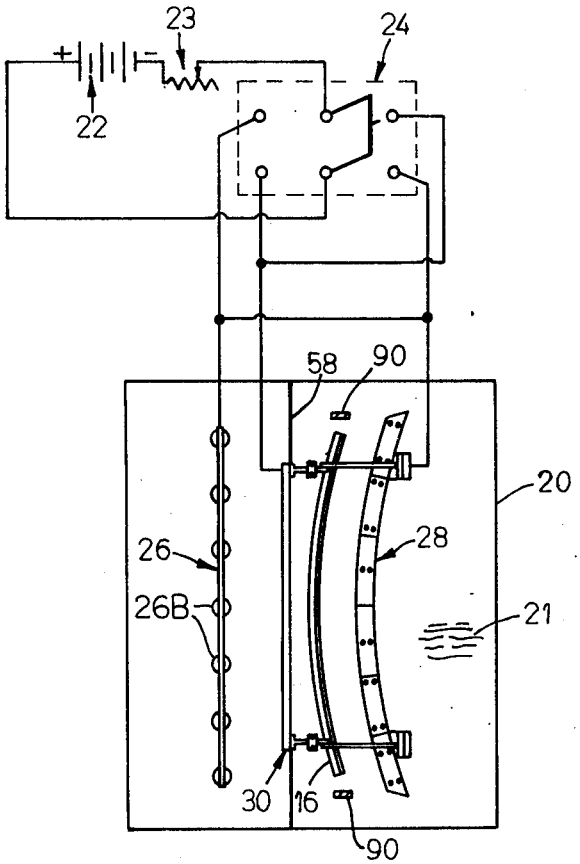
FIG. 5 is a top plan view in schematic form of apparatus for plating rod cores of the type shown in FIGS. 3 and 4 in accordance with the invention.
Figure 6:
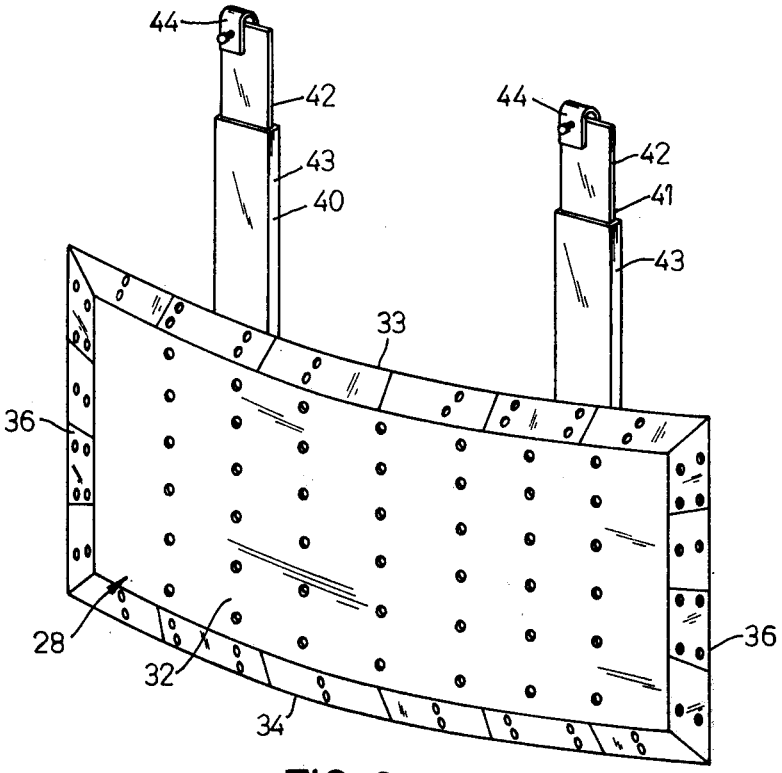
FIG. 6 is an enlarged perspective view of the front of the plating anode shown in FIG. 5.
Figure 7:
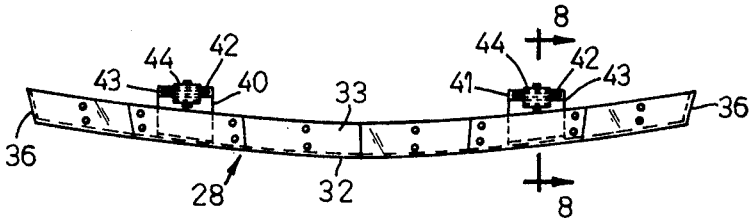
FIG. 7 is a top plan view of the plating anode shown in FIGS. 5 and 6.
Figure 8:
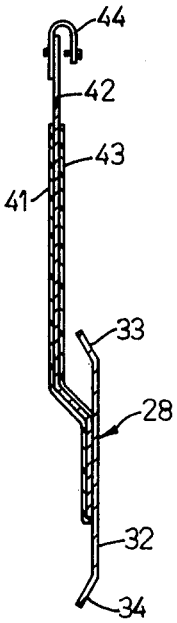
FIG. 8 is a cross section view of the plating anode taken on line 8—8 of FIG. 7.
Figure 11:
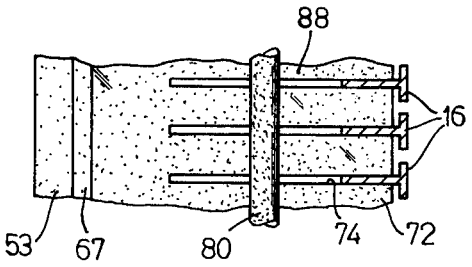
FIG. 11 is an enlarged side elevation view, partly in cross section, taken on line 11—11 of FIG. 9.
Figure 10:
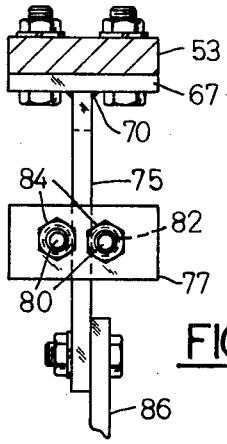
FIG. 10 is an enlarged top plan view of one side of the rod core supporting and connecting means taken on line 10—10 of FIG. 9.
Figure 9:
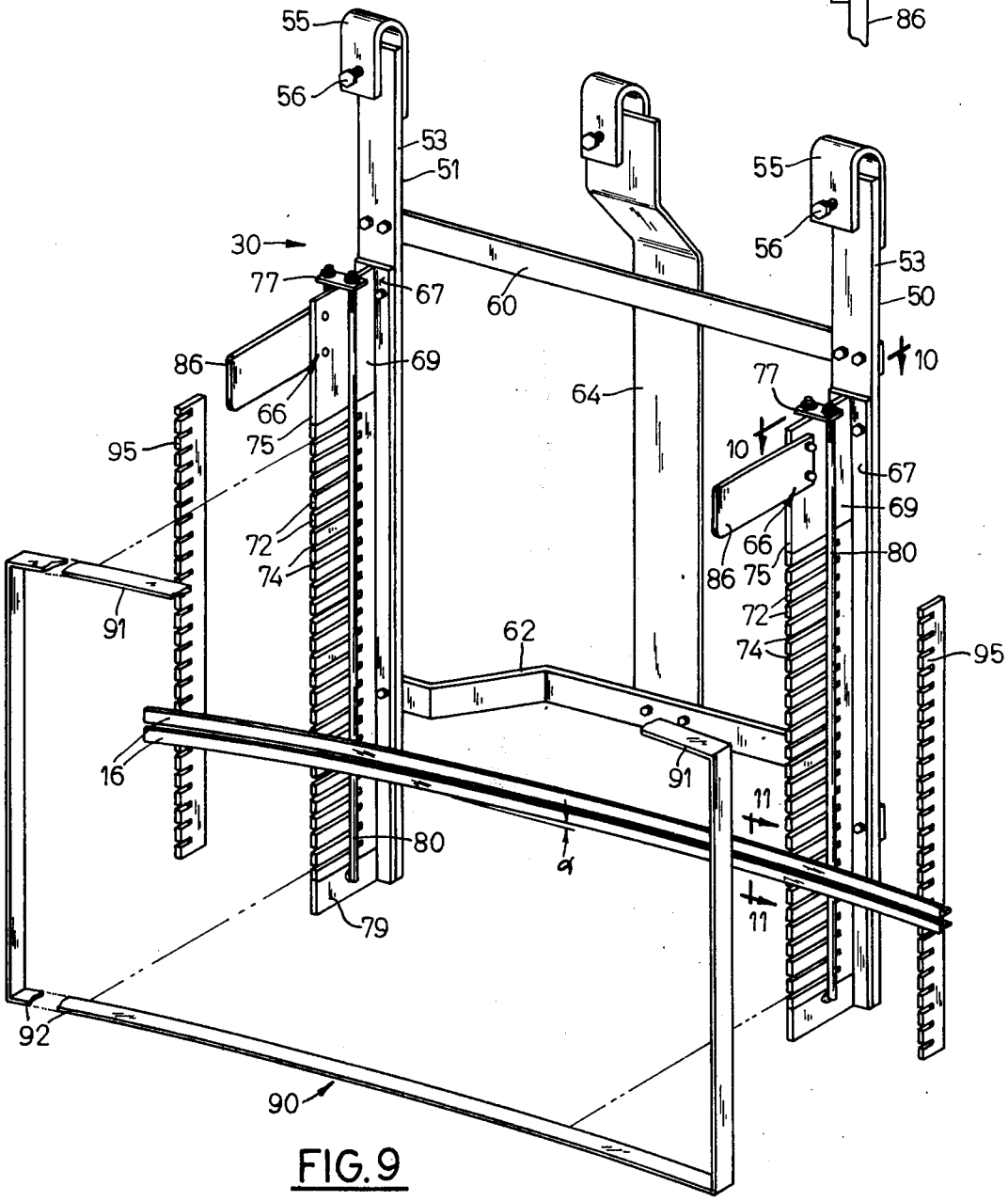
FIG. 9 is a perspective view of the rod core supporting and connecting means or frame shown in FIG. 5.

As FIG. 5 shows, apparatus in accordance with the present invention generally comprises a plating tank 20 containing suitable chromium plating bath 21, a source of reversible adjustable direct current including a power supply 22, a variable resistor or rheostat 23 and a reversing switch 24, lead alloy plating anode means including two sections 26 and 28 hereinafter described, and a rod core supporting and connecting means, holder or frame 30 for holding one or more rod cores such as 16 immersed in the plating bath.

The plating anode means are fabricated of a known standard lead-tin-antimony plating alloy comprising 25% more working area than the total cathode area, including the rod core area being plated and exposed uninsulated portion of the supporting frame. The plating anode means are physically arranged or disposed in separate sections so that one is located on one side of a rod core to be plated and another section is located on the opposite side of a rod core to be plated. The shape, disposition spacing, distance and amount of conforming anode in front causes proper distribution of chrome to the wear surfaces of the rod core. The distance, placement, and amount of anode in back causes proper current distribution to properly plate the sides and rear of the rod core. The shape and disposition of the plating anodes with respect to the shape and configuration of the rods insures that plating material is evenly deposited on all rod surfaces and, particularly in connection with the irregularly shaped profile rods 15, prevents the build-up of uneven sharp corners of plating material at the corners or edges of the front principal working surface of the rods. For example, as shown in FIGS. 13 through 16, in plating an elongated rod core 11 of regular symmetrical circular cross section, a plating anode section 26A comprising about 50% of the total anode area is disposed on one side of the rod core 11 and another plating anode portion 28A comprising about 50% of the anode area is disposed on the opposite side of the rod core 11. In plating a profile rod core 16, as shown in FIG. 5 for example, which has a generally T-shaped or irregular cross sectional configuration, a plating anode section 28 comprising about 66% of the total anode area is disposed on the side of the profile rod core 16 of larger area and a plating anode section 26 comprising about 34% of the anode is disposed on the opposite side of the profile rod core. This enables a plating of greater thickness to be applied to the surface of the rod core which faces anode section 28. Such plating thickness may be on the order of four to five times greater than that on the rear surfaces of rod core 16. Each section 26 and 28 of the plating anode may comprise one or more discrete anode members, such as the seven members 26B of anode 26 hereinafter described. The frame includes electrically conductive terminal means for electrically connecting two spaced apart points on each rod to one side of the direct current source, and a generally rectangular electrically conductive theiver which is electrically connected to the same side of the direct current source as the rods and physically surrounds and generally conforms to the shape of those portions of the rod or rods which are immersed in the bath and to be plated. The holder and theiver have an effective electrically conductive exposed surface area equivalent to about 7.7% of the total cathode area including the rod or rods being plated and exposed portions of the supporting frame.

As FIGS. 5, 6, 7 and 8 show, in the apparatus for plating profile rod cores 16, section 28 of the plating anode means takes the form of a lead alloy anode member or plate 32 located on one side of the frame 30 and which is curved to conform to the arcuate shape of the profile rod cores 16 and is provided with an upper edge 33, a lower edge 34 and side edges 36 which are offset, formed or bent about 10° in a direction away from the rod cores to insure even current flow and proper deposition of the plating on the profile rod cores. Anode section 28 is spaced about 8 inches from the rods 16. Plate 32 is provided on the rear side thereof with a pair of laterally spaced apart electrically conductive support members 40 and 41, each of which take the form of a copper member 42 covered with lead sheet 43 having its lower end mechanically and electrically connected to the plate and having a terminal 44 at its upper end for supporting it on the plating tank member 58 and for connection to the power source. The lead sheet 43 protects the copper against the action of the chromic acid and aids in current distribution. The other section 26 of the plating anode means takes the form of seven discrete elongated vertically disposed cylindrical anode members 26B extending about 30 inches below the surface level of the chromic acid bath which are arranged in a predetermined spaced apart relationship about 14 inches from the center of the rear side of the profile rod cores 16 to insure even dispersion of the chromium plating on all surfaces of the profile rod cores 16. In the embodiment shown in FIG. 5 the seven anode members 26B are preferably spaced apart equidistantly from each other.

As FIGS. 5 and 9 through 11 show, frame 30 for supporting a plurality of profile rod cores 16 for plating and for electrically connecting them to one side of electric power source 23 is constructed as follows. Frame 30 comprises a pair of vertically disposed laterally spaced apart electrically conductive side members 50 and 51. Each side member 50, 51 comprises a flat electrically conductive copper bus bar 53 about fout feet long, about two inches wide and ½ inch thick. A U-shaped steel connector hook 55 having a connector bolt 56 is secured as by soldering and bolting to the upper end of the bar 53 and adapts it for rigid suspension from a support frame member 58 on tank 20. The copper bars 53 of the members 50 and 51 are mechanically and electrically connected together near their upper ends by bolting to a steel upper cross brace 60 on the order of 30 inches long, 2 inches wide and ½ inch thick, and are connected together by bolting near (about one foot from) their lower ends by a U-shaped electrically conductive copper lower cross brace connector 62 on the order of 2 inches wide and ½ inch thick. A copper conductor 64 on the order of 4 inches wide and ½ inch thick and having a hook portion at its upper end is electrically connected as by bolting and soldering to the center of lower connector 62.

Each side member 50, 51 further comprises a rod support assembly 66 electrically and mechanically connected to the flat front surface of its copper rod 53. Each support assembly 66 comprises a steel rear plate 67 and 33 inches long, 2 inches wide and ¼ inch thick which is sweat-soldered and bolted to the front of rod 53. Each support assembly 66 further comprises a forwardly projecting steel plate 69 which is about 33 inches long and ¼ inch thick and is welded as at 70 (see FIG. 10) to the front side of plate 67. Forwardly projecting plate 69 has a front edge which is slotted so as to provide a plurality of steel pieces 72, each on the order of 4 inches long, ½ inch thick and ¼ inch wide, which define a plurality of vertically arranged slots 74 on the order of 0.095 inch wide. A larger steel plate 75 is welded to and above the upper end of forwardly projecting plate 69 and serves to support a cross-plate 77 which is welded thereto. Similarly, a steel plate 79 is welded to and below the lower end of plate 69 and serves to anchor an elongated U-bolt 80 which has its two uppermost threaded free ends extending through a pair of unthreaded bolt-holes 82 in cross-plate 77. Each threaded end of a bolt 80 accommodates an adjustment nut 84. Tightening of the nuts 84 decreases the width of the slots 74 to securely fasten the shank of a profile rod 16 therein and loosening of the nuts permits the rod to be inserted in or removed from a slot. The steel plates 75 for the side members 50 and 51 are of different lengths so that the first uppermost slots 74 thereof are spaced 6⅞ inches and 8⅞ inches, respectively, below the upper ends of the support assemblies 66. In this manner, the complementary or opposite pairs of slots 74 on the side members 50 and 51 are vertically offset about 2 inches from each other so that each profile rod core 16 is held at an angle $\alpha$ of about 5% from the horizontal to facilitate dispersal of hydrogen bubbles being formed during plating on the under surfaces of the rod core 16. The frame 30 is provided with bumper or spacing means in the form of nonconductive plates 86 bolted to the plates 75 for automatically spacing the frame and the profile rod cores thereon a predetermined distance from the plating anode section 28, as FIGS. 5 and 9 make clear. All submersible portions of frame 30, except the foremost horizontal edges of the slots 74 which engage and electrically connect to the rod core shanks are coated with an electrically insulating substance 88 (see FIG. 11) so as to prevent frame contact with the plating bath. Such insulating substance may, for example, take the form of a vinyl plastisol coating made by the Dennis Chemical Company, or B. F. Goodrich, or Unichrome Coating No. 323-Red made by the Metal & Thermite Corporation of New Jersey.

The frame 30 is provided with a detachable theiver 90 in the form of an electrically conductive rectangular member having upper and lower segments 91 and 92 which are slightly longer than the rod cores 16, of the same curvature, and are adapted to be secured in the appropriate slots 74 in frame 30. Theiver 90 surrounds the portions of the rod cores which are to be plated. Spacers 95 are provided at the ends of the rod cores 16.

The size and arrangement of frame components, the disposition of the rod cores thereon, and the current path through the frame and theiver, as well as the size, arrangement and proportion of the anode means ensure even current flow to all rod core surfaces and insure even plating of proper thickness. The construction of frame 30 is such as to insure quick, regular and firm mechanical and electrical connection of the rod cores 16 and theiver 90 to the frame and thence to the power source 22.

Figure 12:
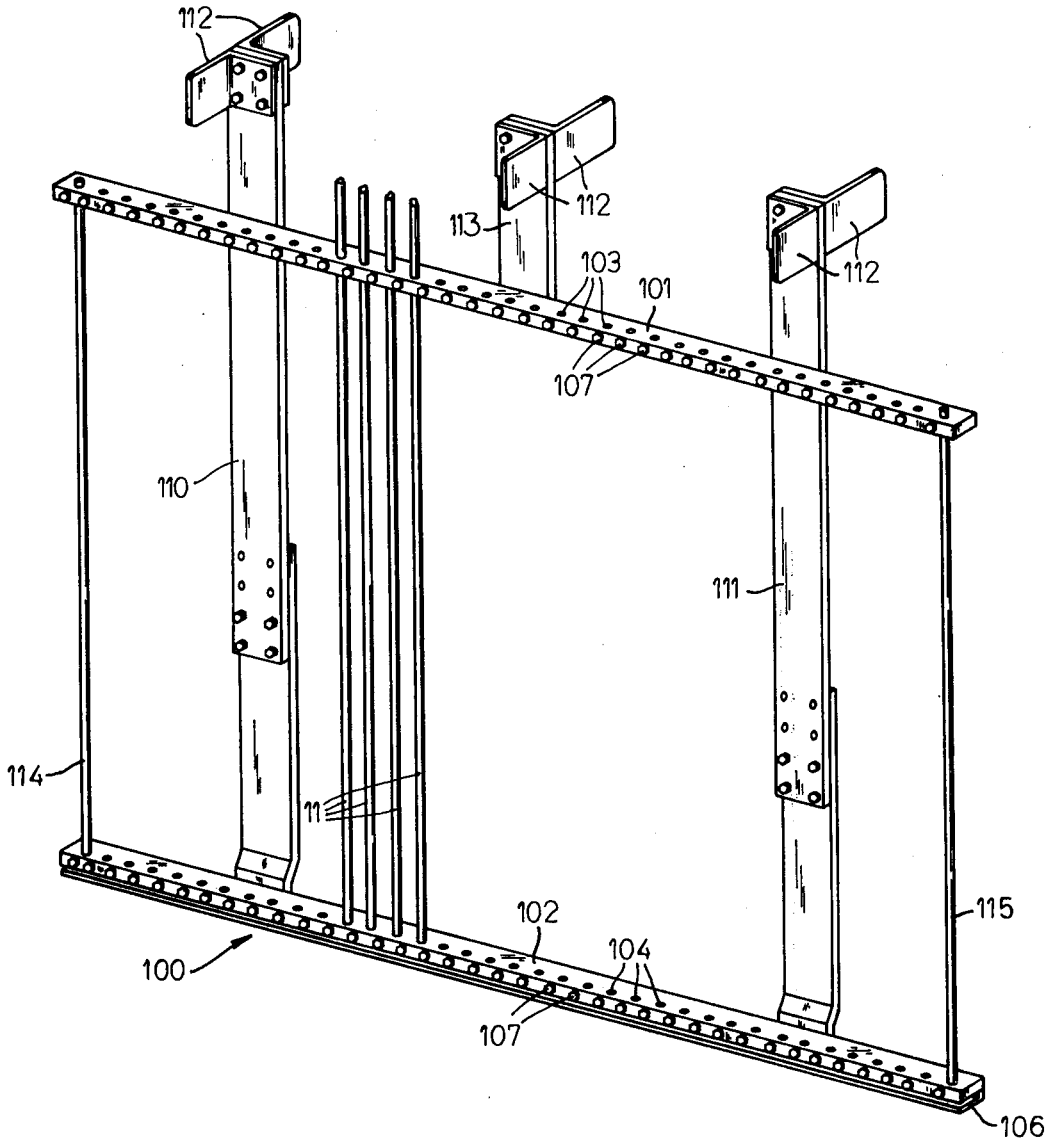
FIG. 12 is a perspective view of a type of support frame for use in plating elongated rod cores of circular cross section in accordance with the invention.
Figure 13:
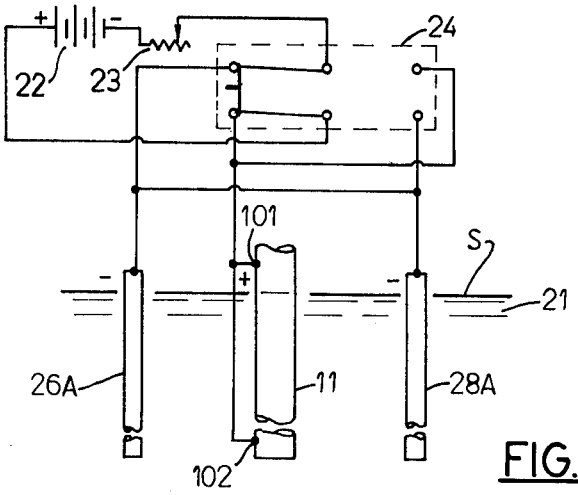
FIGS. 13, 14, 15 and 16 schematically depict method steps carried out in connection with plating elongated rod cores of the type shown in FIGS. 1 and 2 in accordance with the invention.
Figure 14:
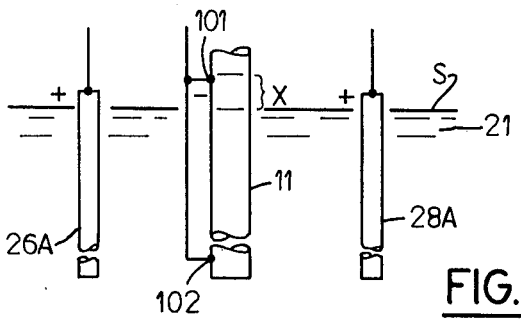
Figure 15:
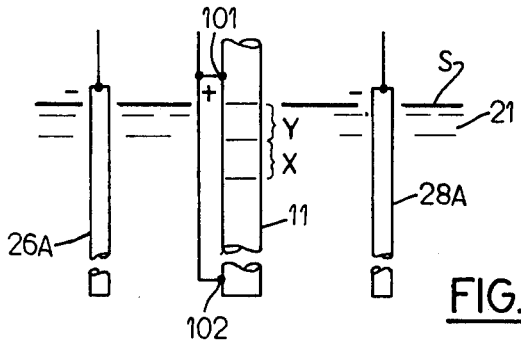
Figure 16:
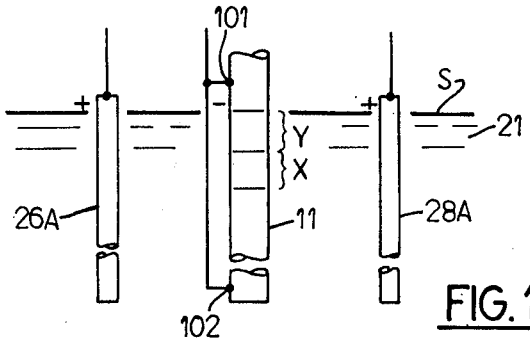

As FIG. 12 shows, a frame 100 for supporting a plurality of relatively long straight rod cores 11 having a generally circular cross sectional configuration comprises electrically conductive horizontal upper and lower members 101 and 102 for supporting and electrically connecting a plurality of rod cores 11 in generally horizontally spaced apart relationship, with each rod core 11 extending substantially vertically through holes 103 and 104 in the rods 101 and 102, respectively, whereby hydrogen bubbles are easily dispersed from the rod surface.

Lower member 102 has a metal stop strip 106 welded along its bottom surface to physically support the rod cores 11 at their lower end. Strip 106 is arranged in spaced relationship from the bottom surface of lower member 102 so that the plating solution can drain from the holes 104 when frame 100 is removed from the plating bath.

Adjacent each hole 103 and 104 is an electrically conductive set screw 107 which can be screwed against an associated rod core 11 to ensure that the rod is in good electrical contact with the upper and lower members 101 and 102 during etching and plating. The lower portions of the rod cores 11, i.e., those rod core portions disposed between the upper and lower members 101 and 102, are submerged in the plating bath and plated first. Subsequently, frame 100 is withdrawn from the plating bath, the rod cores are reversed on the frame 100, the frame is submerged in the plating bath and the remaining portions of the rod cores are then etched and plated as hereinafter explained. The frame members 101 and 102 electrically connect two spaced apart points on each rod core 11 to one side of the direct current source 22. In particular, upper member 101 is electrically connected near a point intermediate of the ends of a rod core 11 and the lower member 102 is connected near the lower end of the rod core.

The upper and lower members 101 and 102, respectively, are adapted for electrical connection to a side of the electric power source by means of horizontally spaced apart copper bus bars 110 and 111, each of which is electrically and mechanically connected to the members 101 and 102. The copper bus bars 110 and 111 are each provided with a pair of copper conductors 112 at the upper ends thereof on the front and rear surfaces thereof. Upper member 101 is further provided with a copper bus bar 113 which is electrically and mechanically connected near the middle thereof and which is also provided with a pair of copper conductors 112.

Frame 100 is provided with theiver means for the portions of the rod cores 11 disposed thereon for plating. Such theiver means comprise the upper and lower members 101 and 102 and a pair of electrically conductive rods 114 and 115 disposed in the endmost holes 103 and 104 in the upper and lower members 101 and 102, respectively. Adjacent rod cores 11 being plated electrically interact with each other and with the rods 114 and 115 during plating to effect the theiving function.

As FIGS. 13 through 16 show, the method of plating elongated rod cores such as 11 comprises the step of: (FIG. 13) submerging the lower portion of a rod core 11 below the surface S of the plating bath 21 and establishing current flow from source 22 to effect etching of the entire submerged portion of the rod core; (FIG. 14) raising the rod core 11 so that about one inch of the etched portion of the rod core (designated X) extends above the surface S of the plating bath 21 and establishing current flow to effect plating of the submerged etched portion of the rod core; (FIG. 15) removing the rod core 11 from the bath, reversing the rod core, resubmerging the rod core so that the unetched portion of the rod core, the etched portion X and about one inch of the plated midportion of the rod core (designated Y) are submerged in the bath, and establishing current flow to etch all submerged portions of the rod core; and (FIG. 16) establishing current flow to effect plating of all submerged portions of the rod core including sections X and Y. This results in a plating overlap as shown in FIG. 1 and ensures that an unplated or poorly plated section does not exist near the middle of the rods 10 because of their being turned end-for-end during plating. Plating procedures for the rods 10 are carried out in accordance with the general method steps already described in connection with the profile rods 15.

We claim:

1. Apparatus for electroplating a plurality of elongated metal rods comprising:

a source of direct current comprising a pair of output terminals of opposite polarity;

means for selectively reversing the polarity of said pair of output terminals to initially effect etching and then to effect plating;

a support frame for said rods including a pair of spaced apart elongated electrically conductive insulated members;

means for rigidly supporting said conductive members in spaced apart relationship;

first and second electrical connecting means for electrically connecting different points on said conductive members to said one output terminal;

releasably adjustable clamping means on each of said electrically conductive members for releasably supporting said rods at a non-horizontal angle to facilitate upward travel of gas bubbles formed on a surface of said rods during plating and for electrically connecting two spaced apart points on each rod to one of said output terminals;

an electrically conductive thiever on said support frame electrically connected to said conductive members and adapted to lie in substantially the same plane in which said rods are adapted to lie and adapted to surround said rods;

means for electrically connecting at least two spaced apart points on said thiever to said one output terminal; and plating anode means connected to the other of said output terminals and comprising first and second anode sections adapted to be disposed on opposite sides of said rods, each anode section being directly proportional in surface area to the area of the rods it is adapted to confront, with the total surface area of said anode being at least about 25% greater than the total surface area to be plated.

2. Apparatus according to claim 1 wherein said thiever and uninsulated portions of said support frame and components thereon comprise about 7.7% of the total electrically conductive surface area presented to said anode means, including the total surface area of the rods to be plated.

3. Apparatus according to claim 1 wherein one anode section comprises about 66% and the other anode section comprises about 34% of total anode area.

4. Apparatus according to claim 1 wherein said releasably adjustable clamping means comprises spaced apart rod-holding slots extending inwardly from an edge of each of said conductive members and further comprises adjustable means on each of said conductive members for adjusting the size of said rod-holding slots to thereby clamp or release rods adapted to be disposed in said slots.

5. Apparatus according to claim 4 wherein said slots serve as the said means for electrically connecting at least two spaced apart points on said thiever to said one output terminal and for mechanically supporting said thiever.

6. Apparatus according to claim 1 wherein said releasably adjustable clamping means on said elongated electrically conductive members comprises spaced apart rod-holding openings in each of said conductive members and further comprises an adjustable set screw for each said opening.

7. A support frame for releasably supporting a plurality of elongated metal rods to be plated and for electrically connecting them to an electric power source comprising:

a pair of spaced apart elongated electrically conductive insulated members;

means for rigidly supporting said conductive members in spaced apart relationship;

first and second electrical connecting means for electrically connecting different points on said conductive members to a cathode;

releasably adjustable clamping means on each of said electrically conductive members for releasably supporting said rods at a non-horizontal angle to facilitate upward travel of gas bubbles formed on a surface of said rods during plating and for electrically connecting two spaced apart points on each rod to said cathode; and an electrically conductive thiever on said support frame electrically connected to said conductive members and adapted to lie in substantially the same plane in which said rods are adapted to lie and adapted to surround the rods.

8. Apparatus according to claim 7 wherein said releasably adjustable clamping means comprises spaced apart rod-holding slots extending inwardly from an edge of each of said conductive members and further comprises adjustable means on each of said conductive members for adjusting the size of said rod-holding slots to thereby clamp or release rods adapted to be disposed in said slots.

9. Apparatus according to claim 8 which said slots serve as the said means for electrically connecting said thiever to said anode and for mechanically supporting said thiever.

10. Apparatus according to claim 7 wherein said releasably adjustable clamping means comprises spaced apart rod-holding openings in each of said conductive members and further comprises an adjustable set screw for each said opening.

11. A support frame for releasably supporting a plurality of elongated metal rods to be plated and for electrically connecting them to an electric power source comprising:

a pair of spaced apart electrically conductive insulated members, each member having a forwardly projecting edge;

means for rigidly supporting said members in spaced apart relationship;

first and second electrical connecting means for electrically connecting different points on said conductive members to a cathode;

a plurality of slots extendng inwardly from an edge of each of said members, each slot in one member being offset from its corresponding slot in the other member so that a rod adapted to be supported in said slots is held at an angle from horizontal to facilitate dispersal of gas bubbles formed during plating;

an elongated threaded member for each of said conductive members, each threaded member having one end secured to one end of one of said conductive members;

a nut connected to the other end of said threaded member to secure said other end to the other end of said one conductive member to enable the width of the slots to be changed as said nut is rotated relative to said threaded member; and a detachable electrically conductive thiever for clamping engagement in at least some of said slots in said members.

12. A support frame for releasably supporting a plurality of elongated metal rods to be plated and for electrically connecting them to an electric power source comprising:

a pair of spaced apart electrically conductive upper and lower members;

means for rigidly supporting said upper and lower members in vertically spaced apart relationship;

first and second electrical connecting means for electrically connecting different points on said conductive members to a cathode;

a plurality of spaced apart rod-receiving holes extending through said members;

a stop strip secured to and spaced from the bottom surface of said lower member; and an adjustable set screw associated with each rod-receiving hole in said upper and lower members; and electrically conductive thiever means on said frame comprising portions of said upper and lower members and further comprising a pair of spaced apart electrically conductive rods connected between said upper and lower members.

* * * * *